US006137414A

United States Patent [19]

Federman

[11] Patent Number: 6,137,414

[45] Date of Patent: Oct. 24, 2000

[54] ASSET SECURITY TAG

[75] Inventor: Vladimir Federman, Winnipeg, Canada

[73] Assignee: EXI Wireless Systems Inc., Canada

[21] Appl. No.: 09/201,702

[22] Filed: Nov. 30, 1998

[51] Int. Cl.[7] ..... G08B 13/06

[52] U.S. Cl. ..... 340/572.9; 340/539; 340/572.1; 340/572.8

[58] Field of Search ..... 340/572.1, 572.8, 340/572.9, 539

[56] References Cited

U.S. PATENT DOCUMENTS

| | | | |
|---|---|---|---|
| 548,887 | 10/1895 | Murphy | 340/571 |
| 3,701,140 | 10/1972 | Dixon | 340/571 |
| 4,000,488 | 12/1976 | Ephraim | 340/568.2 |
| 4,150,371 | 4/1979 | Scaglione | 340/568.1 |
| 4,300,130 | 11/1981 | Fotheringham et al. | 340/571 |
| 4,394,644 | 7/1983 | Di Leo et al. | 340/571 |
| 4,717,908 | 1/1988 | Phillips et al. | 340/571 |
| 4,992,776 | 2/1991 | Crossfield | 340/572.1 |
| 5,005,125 | 4/1991 | Farrar et al. | 340/572.1 |
| 5,517,177 | 5/1996 | Cantrall | 340/571 |
| 5,570,080 | 10/1996 | Inoue et al. | 340/571 |
| 5,920,261 | 7/1999 | Hughes et al. | 340/539 |

*Primary Examiner*—Glen Swann
*Attorney, Agent, or Firm*—Piper Marbury Rudnick & Wolfe

[57] ABSTRACT

The present invention provides an asset security tag comprising a housing, a transmitter transmitting radio frequency waves, the transmitter located in the housing, an electronic circuit located in the housing and coupled to the transmitter, the electronic circuit transmitting an alarm signal when the asset has been relocated to an unauthorized area, and a tag removal alarm circuit for detecting an unauthorized removal of the asset security tag from the asset and for enabling the transmitter to transmit an alarm signal upon detecting the unauthorized removal, whereby the asset security tag may be secured to an asset, and either unauthorized relocation of the asset or unauthorized removal of the tag from the asset will cause an alarm signal to be transmitted.

14 Claims, 6 Drawing Sheets

Q15
TX
RD
R15
7 TX
6 POWER
6 RD
4 RX MF
VDD
GP0
GP1
GP2
GP3
OSC1
OSC2
100
120
116
114
98
C13
R13
40
C0
Q1
Q2
Q3
Q4
Q5
Q6
Q7
Q8
Q9
C0
118
CLK
RST
CNH
4017
R14
110
112
C12
VDC
OHO
RX

ASSET SECURITY TAG

FIELD OF THE INVENTION

The present invention relates to an asset security tag, and in particular to an asset security tag having an anti-tamper feature.

BACKGROUND

There are numerous environments where it is desirable to assure the security of an asset. For instance, a company may have various valuables located on the company premises and which are at the disposal of employees and other individuals. The employees and individuals may or may not be allowed access to the assets. Employees may be required to handle and otherwise use company assets in order to fulfill the goals of the company. Regardless, it is not intended that the assets leave the company premises, or at least not without authorization by the appropriate individual or department responsible for maintaining control or possession of the company asset.

In department stores and the like, valuable merchandise and company assets are similarly at the disposal of employees and customers. In fact, customers are often encouraged to examine and handle merchandise to assist in a purchasing decision and thereby increase the overall merchandise sales.

Where companies, and other owners of assets, encourage or otherwise allow access to assets, there is an increased likelihood that such assets will be removed from the company premises without authorization, or that the merchandise will be removed without first paying for the goods.

Security personnel are used to monitor such unauthorized removal of assets. However, the effectiveness is limited by the ratio of the number of assets to be protected and the number of security personnel. The effectiveness of security personnel is also limited by the diligence and trustworthiness of the security personnel.

It is known to use asset security tags and a monitoring system to protect assets. The monitors are typically stationed at each doorway or other exit from the area to be secured. The asset tags are secured to the asset and generate signals or otherwise trigger a monitor when the tag comes in close proximity to a monitor. In the event appropriate authorization is obtained to remove an asset from a secured area, the tag is removed from the asset. The asset may now be removed from the secured area without triggering a monitor to generate an alarm.

The prior art includes various arrangements for protecting assets.

U.S. Pat. No. 548,887 shows an alarm system for luggage cases and the like. The system features a switch mounted to the inside of the case bottom. A pin protrudes through an opening in the bottom of the case so that a spring lever is maintained in a spaced relationship from contact pad when the case bottom is resting on the ground. The pin lowers when the case is lifted so that the lever contacts the pad thereby closing a switch so that an audible alarm sounds. U.S. Pat. No. 4,150,371 discloses a tamper indicator for covers/encoders that are bolted to gas or water meters. The device is mounted within the cover and features a spring-loaded actuation rod with a lower end that protrudes down from the cover. As a result, when the cover is in place on the meter, the upper end of the actuation rod prevents a contact spring from contacting a switch terminal. When the cover is removed, the upper end of the actuation rod moves downward so that the spring contacts the terminal and an alarm is activated. In an alternative embodiment, a portion of the pin may remain in contact with the meter when the cover is removed. U.S. Pat. No. 4,394,644 discloses a purse alarm. The alarm features a contact switch within the purse that is connected to an alarm. The contact switch is held open by a pin that extends into the purse from its exterior. As a result, when the pin is withdrawn from the purse, the alarm sounds. The pin may be attached to the belt or other apparel of the wearer by a thin line.

U.S. Pat. No. 4,000,488 discloses an anti-theft alarm system comprising an electric circuit including a signal device and electrical components in said circuit adapted to be attached to an article of merchandise and which are readily destructible to interrupt the circuit and actuate the signal device. Since the label circuitry components are adhered to the sheet and then pressure sensitively secured to the merchandise, any attempt to peel the label from the merchandise will leave portions of the components secured to the adhesive and break the circuit to cause the alarm to sound.

The prior art does not provide an efficient device for detecting unauthorized attempts to remove an asset from a secured area and which also detects unauthorized attempts to remove the security device from the asset.

SUMMARY

It is an object of the present invention to provide an improved asset security tag.

It is a further object of the present invention to provide an asset security tag which allows detection of unauthorized attempts to remove an asset from a secured area.

It is still a further object of the present invention to provide an asset security tag which detects unauthorized attempts to remove the asset security tag from the asset.

It is yet still a further object of the present invention to provide an asset security tag which is reliable, easy to use and economical to manufacture.

The present invention therefore provides an asset security tag comprising: a housing, a means for transmitting radio frequency waves, the transmitting means located in the housing, an electronic circuit located in the housing and coupled to the transmitting means, the electronic circuit having means for enabling the transmitting means to transmit an alarm signal when the asset has been relocated to an unauthorized area, and a means for detecting an unauthorized removal of the asset security tag from the asset and for enabling the transmitting means to transmit an alarm signal upon detecting the unauthorized removal, whereby the asset security tag may be secured to an asset, and either unauthorized relocation of the asset or unauthorized removal of the tag from the asset will cause an alarm signal to be transmitted.

DESCRIPTION OF PREFERRED EMBODIMENT OF THE INVENTION

Figure 1:
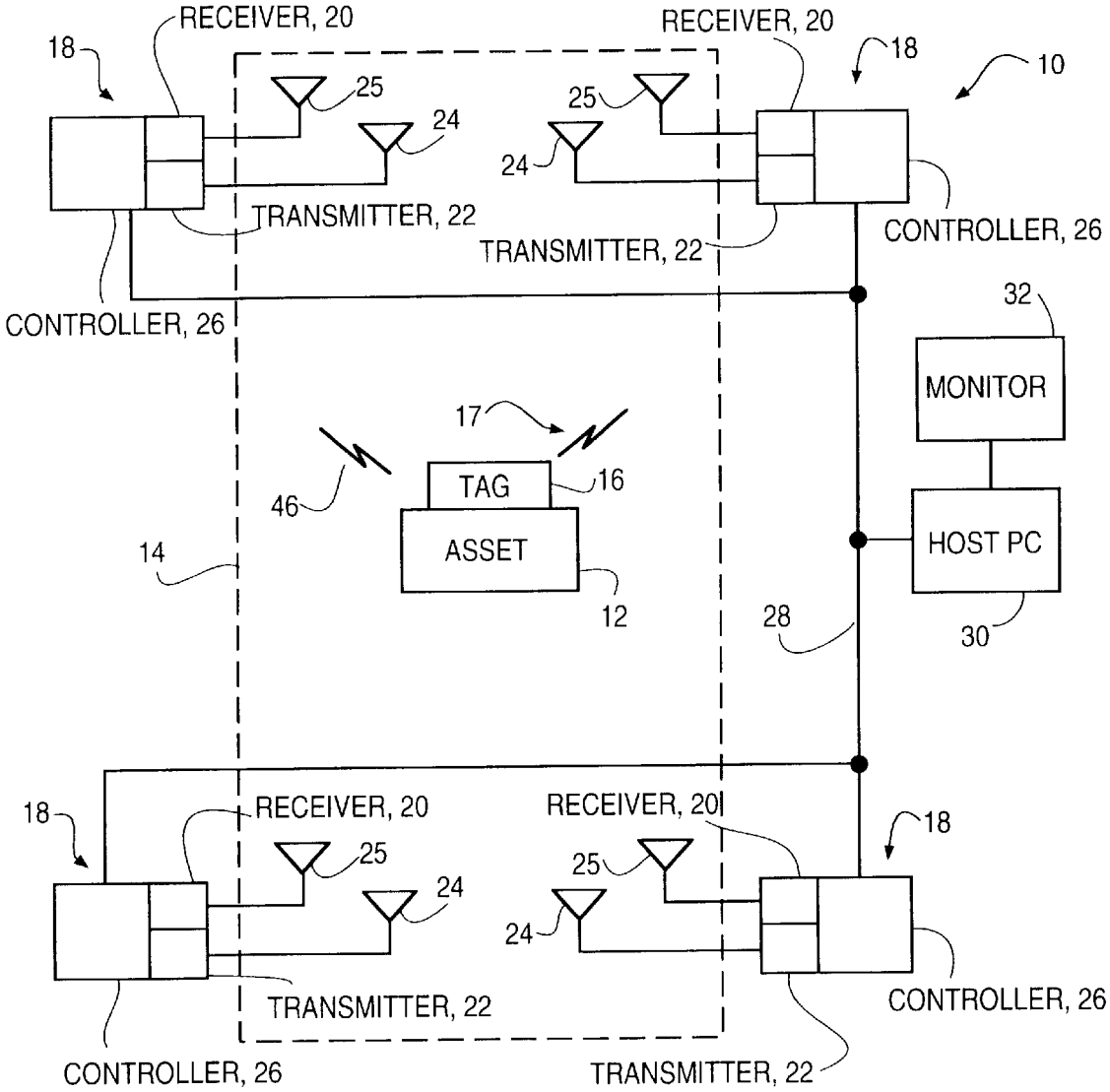
FIG. 1 shows a monitoring system including the asset security tag of the present invention.

FIG. 1 shows a monitoring system 10 for protecting an asset 12. The asset 12 may be, for example, merchandise in a store or equipment of a company used by employees to carry out the business of the company. In the normal course of business, the asset 12 is not to be removed from a secured area 14 without proper authorization. It may or may not be appropriate to relocate the asset 12 within the secured area 14. Affixed to the asset 12 is an asset security tag 16 in accordance with the present invention. The asset security tag 16 is designed not to interfere with the use of the asset 12 while in the secured area 14. The asset security tag 16 is capable of generating an alarm signal 17. The secured area 14 is defined by a plurality of monitors 18 strategically located at points of exits from the secured area 14. The plurality of monitors 18 together with the natural physical barriers which prevent exit from the secured area 14, define the secured area 14. Each of the plurality of monitors 18 includes a transmitter 20 and receiver 22. An antenna 24, 25 is coupled to each of the transmitters 20 and receivers 22. The receiver 22 and antenna 24 of each monitor 18 are capable of detecting the alarm signal 17 generated by the asset security tag 16 if the asset security tag 16 is within range of the receiver 22 of the monitor 18. In the preferred embodiment, if the asset 12 with the tag 16 is relocated in close proximity of the monitor 18, the field radiated by transmitter antenna 25 wakes up the tag 16. As a consequence, the tag 16 transmits signal 17 to the one particular monitor 18, and an alarm is triggered. Therefore, each of the monitors 18 is positioned at a respective point of exit in a manner whereby the asset 12, and consequently the asset security tag 16, will pass in close proximity to the monitor 18 upon exiting of the secured area 14. In this manner, only one of the plurality of monitors 18 will detect the presence of the asset security tag 16 and accompanying asset 12. Such singular detection of an attempt to remove an asset 12 from the secured area 14 is beneficial in any subsequent attempts to retrieve the asset 12 being removed from the secured area 14 and apprehend the individual in connection with such unauthorized removal. In particular, each of the monitors 18 includes a controller 26 coupled to the transmitter 20 and receiver 22. Each controller 26 is coupled via a network 28 to a host monitoring system, for example, a host PC 30. Upon a monitor 18 detecting the presence of an alarm signal from an asset security tag 16 in the range of the receiver 22, such alarm signal detection will be communicated to the host PC 30. The host PC 30 will in turn provide an alarm indication to a security monitor 32. The host PC 30 may be located within the secured area 14, or within the same premises but outside the secured area 14. Alternatively, the host PC 30 may be located off-site and be coupled to the network 28 via a wide area network (not shown), for example. The monitor 32 may be a video monitor which is monitored by a security personnel. Alternatively, the monitor 32 may be a combination of visual or audio indicators for monitoring by security personnel or others.

As can be appreciated, the host PC 30 is capable or providing an indication of an unauthorized attempt to remove an asset 12 from the secured area 14, but will also provide an indication of the particular exit point where the breach is being attempted. The security personnel can then be dispatched directly to the exit where the breach is being attempted, thus providing the maximum likelihood of retrieving the asset 12 being removed and apprehending the individual attempting to remove the asset 12.

Figure 2:
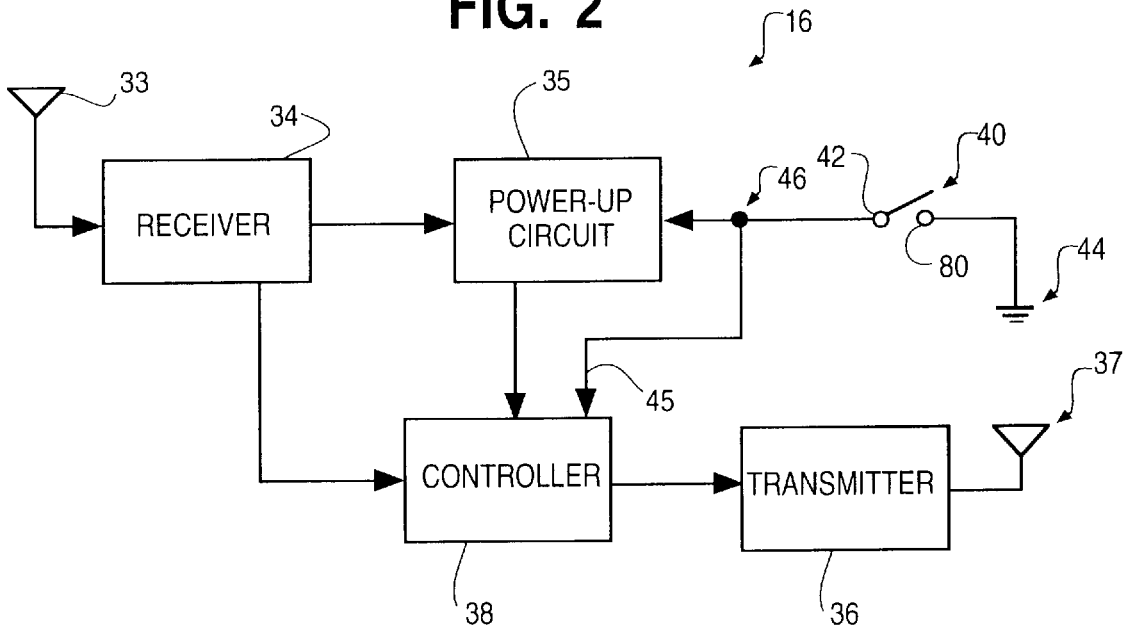
FIG. 2 shows a block diagram of the asset security tag of the present invention.

FIG. 2 discloses a functional block diagram of the asset security tag 16 shown in FIG. 1. The asset security tag 16 includes a receiver antenna 33, receiver 34, power up circuit 35, transmitter 36, transmitter antenna 37 and controller 38. In the preferred embodiment, the controller 38 is a microprocessor based circuit and is capable of causing the asset security tag 16 to transmit via the antenna 37 and receive digital data via antenna 33. For instance, the alarm signal 17 transmitted by the asset security tag 16 may provide information specific to the asset 12 being protected. For example, the alarm signal 17 may indicate the original location of the asset 12, and a description and serial number of the asset 12. Upon detection of the alarm signal 17 by one or more of the plurality of monitors 18, the asset specific information may also be communicated to the host PC 30 to further assist in attempts to retrieve the asset 12 being removed from the secured area 14. For example, in the event a plurality of assets 12 are being removed from the secured area 14 via a common exit and with authorization to do so, and simultaneously therewith an asset 12 is being removed via the same exit point and without authorization, it would be beneficial to security personnel to distinguish which of the assets 12 is being removed without authorization. Usually in such situations, time is of the essence and any assistance in identifying the asset 12 being removed without authorization will increase the likelihood of successfully retrieving the asset 12 and apprehending the individual removing the asset 12 without authorization.

FIG. 2 also shows a tag removal alarm circuit 40 which includes a tamper alarm signal switch 42. The tamper alarm signal switch 42 is coupled between the controller 38 and a reference potential 44. The reference potential 44 is shown in FIG. 2 to be a ground reference. However, it will be appreciated that the reference potential 44 may be any other appropriate voltage potential as will be understood by one skilled in the art.

In the preferred embodiment, the tamper alarm signal switch 42 is a normally-open switch. As will be described in greater detail below, in the event the asset security tag 16 is removed from the asset 12, the tamper alarm signal switch 42 will be closed and thereby generate a signal at the input 45 of the controller 38. The controller 38 upon detecting the signal at the input 45 will cause the asset security tag 16 to generate an alarm signal 46 (FIG. 1) indicating that the asset security tag 16 has been removed from the asset 12. The alarm signal 46 will also include the other information specific to the asset 12 as described above. In the preferred embodiment, the "tamper" alarm signal 46 has a predetermined greater signal strength which is capable of detection by at least one of the plurality of monitors 18. The monitor 18 will as before transmit the information to the host PC 30 via the network 28. The host PC 30 will provide the appropriate indication to the security monitor 32 to assist the security personnel to locate and retrieve the asset 12 and apprehend the individual removing the asset 12.

Figure 3:
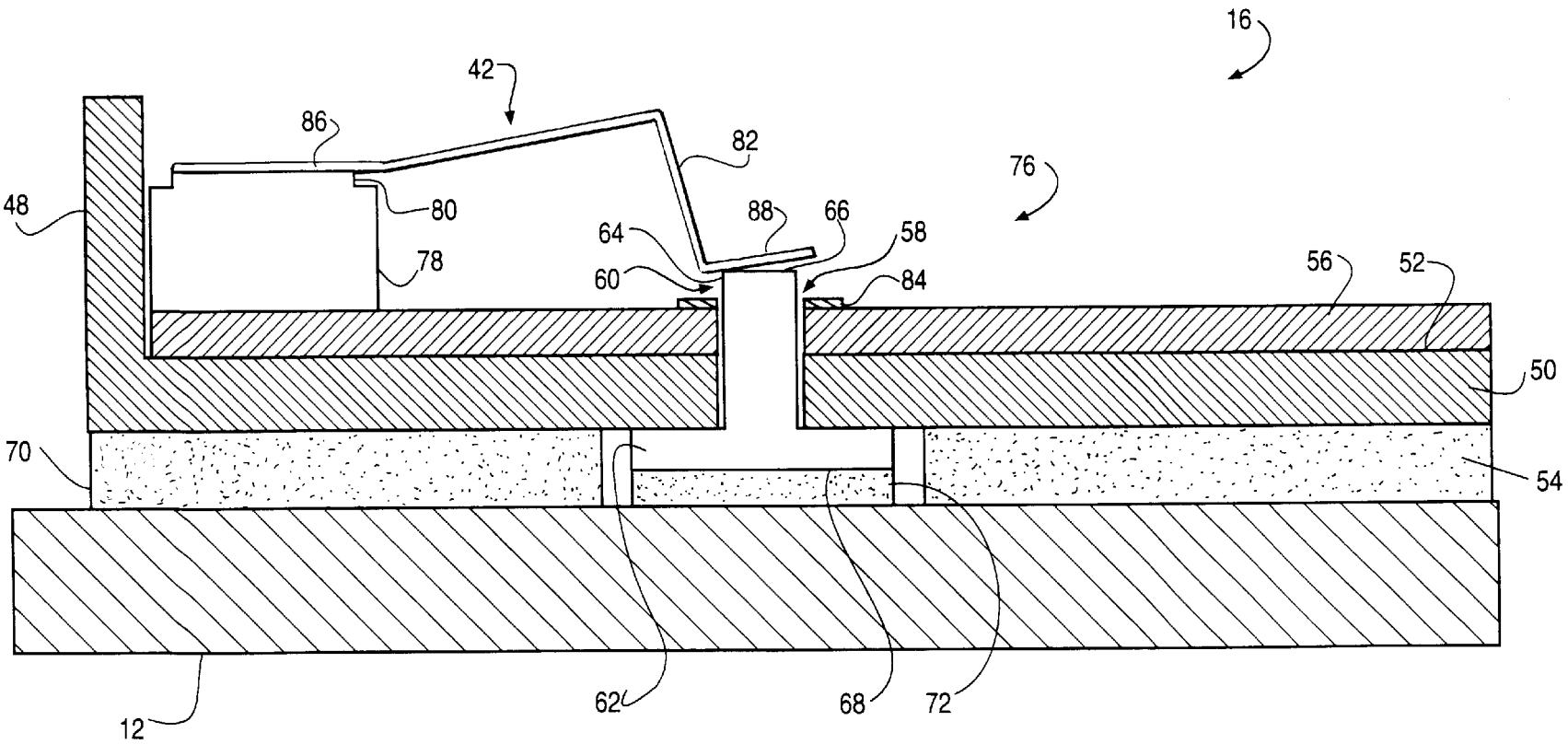
FIG. 3 shows a partial cross-sectional view of the tag removal alarm circuit of the asset security tag of the present invention shown secured to an asset.
Figure 5:
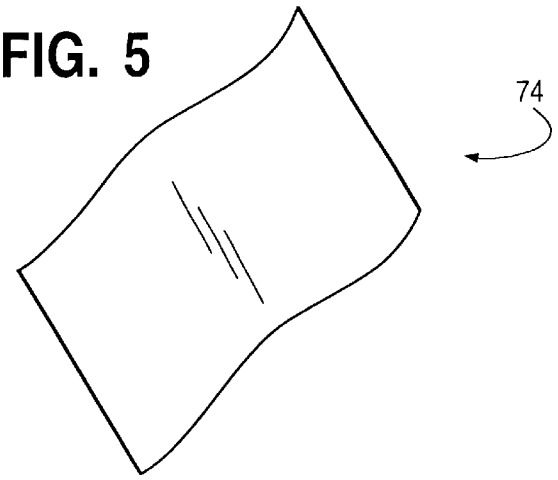
FIG. 5 is a plain view of a protective non-stick layer used in connection with the present invention.

FIG. 3 shows a partial cross-sectional view of the asset security tag 16 and asset 12 of the FIG. 1. The asset security tag 16 is shown to include a housing 48 having a base 50. The base 50 includes an inner surface 52 and an outer surface 54. Secured within the housing 48 and to the inner surface 52 is a printed circuit board (PCB) 56 providing the circuit (i.e., switch 40, the controller 38, receiver/transmitter 34,36 and antenna 33,37 etc.) for the asset security tag 16. An opening 58 extends through the base 50 and the PCB 56. A member 60 is shown to include a substantially flat base portion 62. A pin portion 64 extends from the substantially flat base portion 62. The pin portion 64 includes an end 66. The substantially flat base portion 62 includes an outer surface 68. The pin portion 64 extends through the opening 58. The outer surface 54,68 of the housing 48 and the member 60 include an adhesive 70,72 for securing to the asset 12. In the preferred embodiment, the adhesive 72 on the housing 48 has a greater adhesion factor than the adhesive 70 on the member 60. Prior to the asset security tag 16 being secured to the asset 12, the adhesive 70,72 of the housing 48 and member 60 is protected by a protective non-stick layer 74 (See FIG. 5). The protective non-stick layer 74 may be removed at the time the asset security tag 16 is to be affixed to an asset 12. In the preferred embodiment, the opening 58 extends through a substantially central portion 76 of the base 50 of the housing 48. As will be appreciated, the adhesive bonding between the housing 48 and the asset 12 provides a water-resistant seal notwithstanding the opening 58 which extends through the base 50 and PCB 56.

A button cell battery 78 is electrically coupled to the PCB 56. The battery 78 includes a terminal 80. The tamper alarm signal switch 42 is shown in FIG. 3 to include a spring biased arm 82 and a conductive pad 84. The spring biased arm 82 includes one end 86 secured to the terminal 80 of the battery 78 and a distal end 88. The distal end 88 is shown in FIG. 3 to be in engagement with the end 66 of the member 60 and spaced apart from the conductive pad 84. The conductive pad 84 may be an annular ring shaped conductive pad surrounding the perimeter of the opening. Alternatively, the conductive pad 84 may be formed in a discontinuous pattern around the perimeter of the opening 58. In addition, the conductive pad 84 in the preferred embodiment is made of gold to enhance the electrical conductive characteristics of the tamper alarm signal switch 42.

Figure 4:
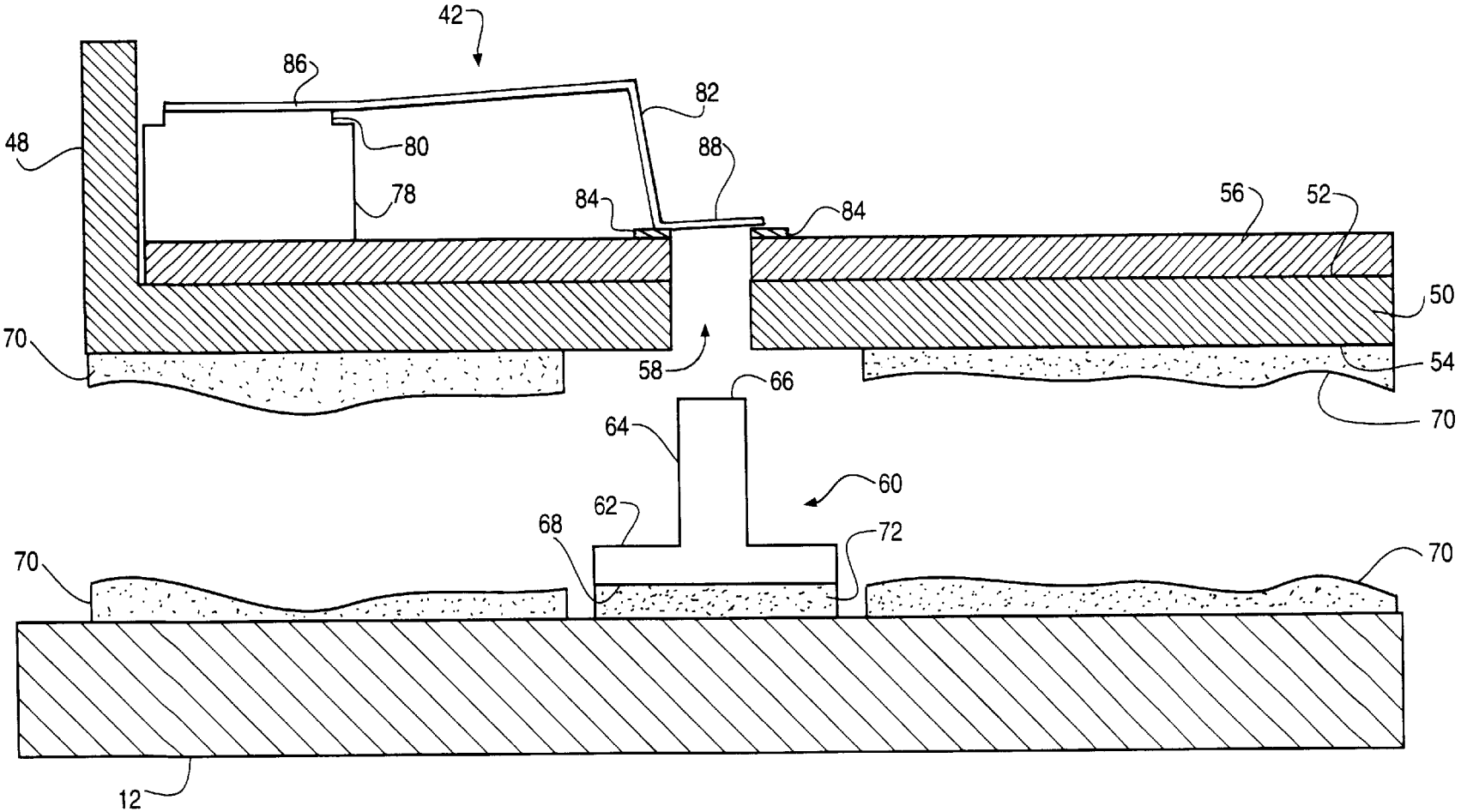
FIG. 4 is a view similar to FIG. 3 but where a portion of the asset security tag of the present invention has been removed from the asset.

As will be appreciated from FIG. 4, in the event the asset security tag 16 is pried or otherwise removed from the asset 12, the member 60 with the adhesive 72 having a greater adhesion factor, will remain affixed to the asset 12. As a result, the pin portion 64 will be extracted from the opening 58 of the base 50 allowing the spring biased arm 82 to move into electrical contact with the conductive pad 84 and thereby close the tamper alarm signal switch 42. Upon closure of the tamper alarm signal switch 42, the reference potential 44 will be coupled to the controller input 46 and the controller 38 will cause the asset security tag 16 to generate a "tamper" alarm signal 46 as mentioned above.

Figure 6:
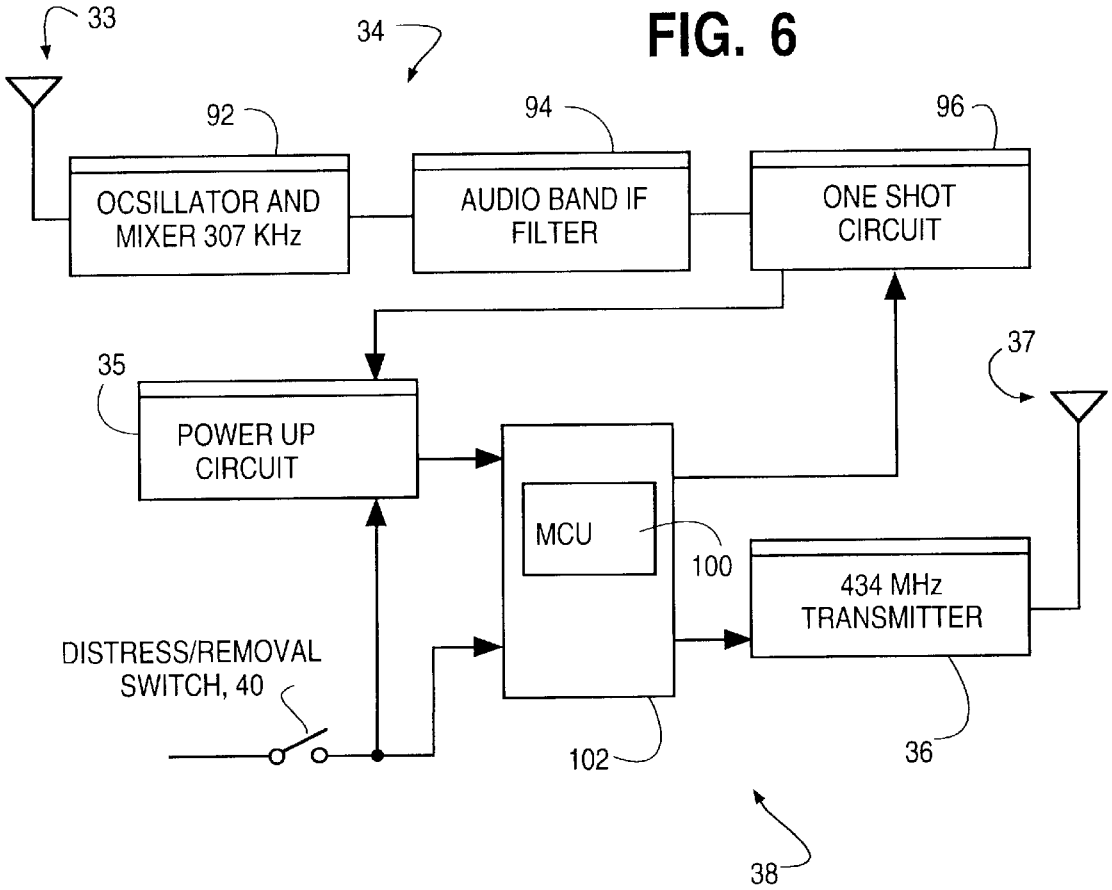
FIG. 6 shows a block diagram similar to FIG. 2 but in greater detail.

FIG. 6 shows a block diagram similar to FIG. 2 but in somewhat greater detail. The receiver antenna 33 is shown coupled to an oscillator and mixer 92. The mixer 92 is coupled to a filter 94 which is coupled to a one shot circuit or signal conditioner 96. The output of the signal conditioner 96 is the data received by the antenna 33 and is coupled to the power up circuit 35. The burst of data from the antenna must be recognized by the power up circuit 35 in order to develop an output at the circuit 35. The output at the circuit 35 is used to power up the microcontroller unit 100 and is coupled to the microcontroller circuit 102. The unit 100 will then disable the signal conditioner circuit until the unit 100 anticipates receiving command or other information from the monitor. The command information may be a request for the unit 100 to transmit information identifying the tag or a request to send an alarm signal. In this manner, the unit 100 is not powered unless the tag is interrogated by a monitor or the tag is removed from the asset. The battery life is thereby increased. FIG. 6 also shows the transmitter 36 and transmit antenna 37.

Figure 7:
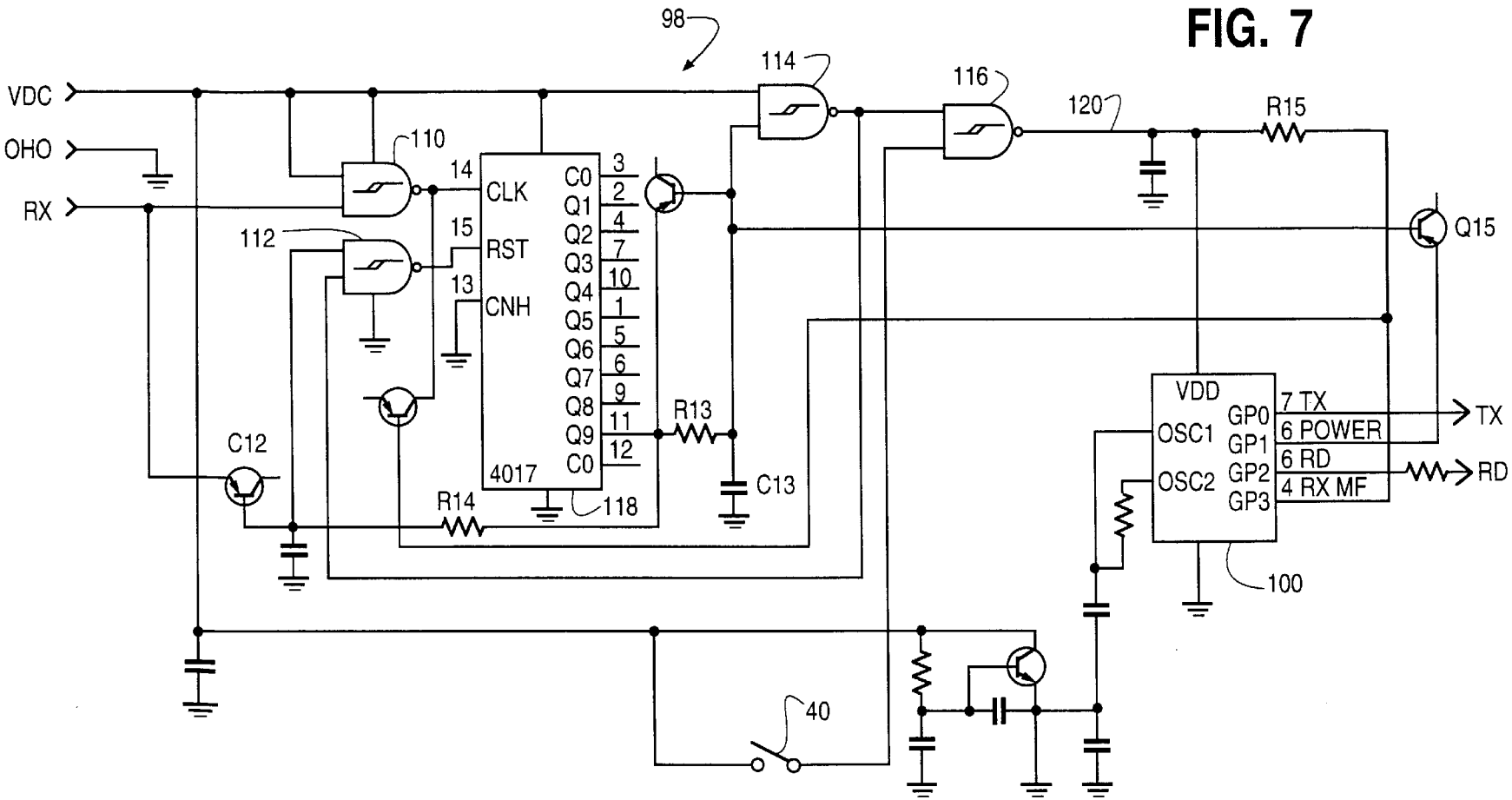
FIG. 7 is a schematic of the power up logic counter shown in FIG. 6.

FIG. 7 shows a schematic of one embodiment of the power up circuit 35 and unit 100. The circuit includes four NAND gates 110, 112, 114, 116 and a Johnston counter 118, or its equivalent. The wake up signal is typically a burst of certain number of pulses followed by a period of silence. The signal may be modulated. The power up circuit is tuned to receive a specific number of pulses in a row. These pulses have certain maximum time from one to the next, within a burst. The burst is followed by a minimum time of silence. The timing is achieved by an RC network. If all these criteria are met the circuit outputs a DC voltage at line 120 to power up the unit 100 or the processing logic. This DC voltage is on only for some minimum time necessary to activate the unit 100. Once the unit 100 is activated it maintains its power up status. If for some reason the unit 100 does not power up or does not provide this maintaining signal, the presence of the DC would be after this minimum time removed, thus powering the unit 100 down.

The signal from the signal conditioner 96 is fed into the RX input. With the leading edge of the signal the capacitor C12 charges up and gate 112 removes the reset condition from the counter 118. If the next pulse does not come within some specified time, the capacitor C12 discharges thru resistor R14 and the counter 118 will be back in the reset state. After bringing the counter 118 out of the reset, the counter 118 is advanced by one with the trailing edge of this first pulse. This process is repeated with the subsequent pulses within the burst, until the counter 118 reaches the predetermined count (which is 9 in this drawing). If there are no other pulses after this (9th) pulse, a positive voltage on output nine will charge the capacitor C13 thru the resistors R13 and R31. The time necessary to charge the capacitor C13 is the minimum time of silence between the bursts. Once the capacitor C13 is charged gates 114 and 116 power up the unit 100. Once the unit 100 is powered up and running, it sends a positive signal thru the diode Q15 to maintain its power. The diode Q15 together with the pull up resistor R15 is used to isolate the clocking signal from the unit 100 during the power down time, and to deliver a signal to the unit 100 during the power up. If more than the predetermined number of pulses is received the counter 118 rolls over. The time output (9) is on is too short to sufficiently charge the capacitor C13. If less than the full number of pulses is received the gate 112 will reset the counter 118.

The description given here of the preferred embodiment of the invention is intended to illustrate the invention. This description is not intended to limit the scope of the invention, which should be interpreted in accordance with the appended claims.

What is claimed is:

1. An asset security tag comprising:

a housing having a base with an opening;

a means for transmitting radio frequency waves, the transmitting means located in the housing;

an electronic circuit located in the housing and coupled to the transmitting means, the electronic circuit having means for enabling the transmitting means to transmit an alarm signal when the asset has been relocated to an unauthorized area; and a means for detecting an unauthorized removal of the asset security tag from the asset and for enabling the transmitting means to transmit an alarm signal upon detecting the unauthorized removal, the detecting and enabling means includes a tag removal alarm circuit located in the housing, the tag removal alarm circuit includes a voltage reference and a conductive element having a first end and a second end, the first end flexibly secured to the housing and electrically coupled to the voltage reference, the second end having an open position and a closed position, in the open position the second end is spaced apart from the opening and the alarm circuit is not completed, in the closed position the second end is adjacent the opening and the tag removal alarm circuit is completed, the conductive element is biased with the second end in the closed position, whereby the asset security tag may be secured to an asset, and either unauthorized relocation of the asset or unauthorized removal of the tag from the asset will cause an alarm signal to be transmitted.

2. The asset security tag of claim 1, wherein the detecting and enabling means includes a member having a base portion and a pin portion, the base portion having a bottom surface, the bottom surface having means for securing to the asset, the pin portion sized to extend through the opening and bias the second end in the open position, whereby with the housing and the member secured to an asset via the securing means, the member maintains the second end in the open position, and if the housing is removed from the asset, the member remains with the asset and the pin portion is extracted from the opening and the second end returns to the closed position and an alarm is transmitted.

3. The asset security tag of claim 2, wherein the wall of the housing has a thickness, and the base portion is substantially flat and thin, the base portion includes a top surface, the pin portion extends from the top surface and has a length greater than the thickness of the wall of the housing.

4. The asset security tag of claim 3, wherein the wall of the housing includes an interior surface, the opening extends through the outer surface and the interior surface, the tag removal alarm circuit includes a conductive pad located on the interior surface of the housing and adjacent the opening, the second end of the conductive element, in the closed position, is in electrical contact with the conductive pad and completes the tag removal alarm circuit.

5. The asset security tag of claim 4, wherein the opening defines a peripheral edge at the interior surface, and the conductive pad is substantially ring shaped and extends along the peripheral edge of the opening.

6. The asset security tag of claim 5, wherein the conductive element is a metal spring arm, the spring arm having the first end flexibly secured to the voltage reference with spring tension biasing the second end toward electrical contact with the ring shaped conductive pad wherein the ring shaped conductive pad is made of gold.

7. An asset security tag to be attached to an asset, the tag capable of transmitting an alarm signal to a receiver of a monitoring system, the asset security tag comprising:

a housing, the housing having a base with an outer surface, the base having an opening, the outer surface having an adhesive for securing to an asset;

a means for receiving and transmitting radio frequency waves, the receiving and transmitting means located in the housing;

an electronic circuit located in the housing and coupled to the receiving and transmitting means, the electronic circuit having means for enabling the receiving and transmitting means to transmit an alarm signal when the asset has been relocated to an unauthorized area, the electronic circuit having means for enabling the receiver and transmitter to transmit an alarm signal when the electronic circuit receives a tag removal signal;

a tag removal alarm circuit located in the housing and which includes a conductive element having a first end and a second end, the first end flexibly secured to the alarm circuit, the second end having a open position and a closed position, in the closed position the second end is adjacent the opening and the alarm circuit is completed and a tag removal signal is developed and coupled to the electronic circuit, in the open position the second end is spaced apart from the opening and the alarm circuit is not completed and a tag removal alarm signal is not developed and coupled to the electronic circuit, the conductive element is biased with the second end in the closed position; and a member having a base portion and a pin portion, the base portion having a surface, the surface having an adhesive for securing to an asset, the pin portion sized to extend through the opening and bias the second end in the open position, whereby with the housing and the member secured to an asset via the adhesive, the member maintains the second end in the open position, and if the housing is removed from the asset, the member remains with the asset and the pin portion is removed from the opening and the second end moves to the closed position and an alarm signal is transmitted.

8. A system for maintaining security of an asset, the system comprising:

at least one asset tag, each of the at least one asset tag having a housing, the housing having a base with an outer surface, the base having an opening, the outer surface having an adhesive for securing to an asset, a means for transmitting radio frequency waves, the transmitting means located in the housing, an electronic circuit located in the housing and coupled to the transmitting means, the electronic circuit having means for enabling the transmitting means to transmit an alarm signal when the asset has been relocated to an unauthorized area, the electronic circuit having means for enabling the transmitter means to transmit an alarm signal when the electronic circuit receives a tag removal signal, and a tag removal alarm circuit located in the housing and which includes a conductive element having a first end and a second end, the first end flexibly secured to the alarm circuit, the second end having an open position and a closed position, in the closed position the second end is adjacent the opening and the alarm circuit is completed and a tag removal signal is developed and coupled to the electronic circuit, in the open position the second end is spaced apart from the opening and the alarm circuit is not completed and a tag removal alarm signal is not developed and coupled to the electronic circuit, the conductive element is biased with the second end in the closed position;

a member having a base portion and a pin portion, the base portion having a surface, the surface having an adhesive for securing to an asset, the pin portion sized to extend through the opening and bias the second end in the open position, whereby with the housing and the member secured to an asset via the adhesive, the member maintains the second end in the open position, and if the housing is removed from the asset, the member remains with the asset and the pin portion is removed from the opening and the second end moves to the closed position and an alarm signal is transmitted;

a security monitor; and at least one secured area, each of said secured areas associated with a respective means for receiving the alarm signal, each of the respective receiving means is coupled to the security monitor.

9. The system of claim 8, wherein the alarm signal provides information specific to the asset associated with the asset tag which developed the alarm signal.

10. The system of claim 9, wherein the specific information includes indicating the approximate location of the tag, the serial number of the tag and the article description.

11. The system of claim 9, wherein, upon a respective receiving means receiving an alarm signal, the security monitor displays the specific information of the received alarm signal.

12. A security tag comprising:

a means for receiving radio frequency waves;

a means for transmitting radio frequency waves;

a micro controller coupled to the transmitting means and the receiving means;

means for detecting that the receiving means received a specific data stream, the specific data stream associated with the security tag; and means for enabling the micro controller upon detecting the specific data stream, whereby the micro controller is normally in a power down mode until the detecting means detects the specific data stream, whereupon power is applied to the micro controller to carry out a task, the security tag thus conserving power consumption by not unnecessarily applying power to the micro controller.

13. The tag of claim 12, further comprising a voltage source, the voltage source being coupled to the receiving means, transmitting means and detecting means, and the enabling means includes means for coupling the voltage source to the microcontroller.

14. The tag of claim 13, further comprising means for maintaining the voltage source coupled to the microcontroller.

* * * * *